United States Patent [19]

Thayer, III

[11] Patent Number: 4,894,582

[45] Date of Patent: Jan. 16, 1990

[54] METHOD AND APPARATUS FOR ENHANCING SPARK CHANNEL RECOVERY BY SPARK-GENERATED UNSTEADY FLOWS

[75] Inventor: William J. Thayer, III, Kent, Wash.

[73] Assignee: Spectra-Physics, Inc., San Jose, Calif.

[21] Appl. No.: 257,377

[22] Filed: Oct. 12, 1988

[51] Int. Cl.[4] ..... H01T 1/08; H01J 7/24

[52] U.S. Cl. ..... 313/231.01; 313/231.71; 315/111.01; 315/344

[58] Field of Search ..... 313/231.01, 231.11, 313/231.21, 231.71; 315/111.01, 111.11, 111.81, 344

[56] References Cited

U.S. PATENT DOCUMENTS

| | | | |
|---|---|---|---|
| 4,027,187 | 5/1977 | Rabe | 313/231.01 |
| 4,052,639 | 10/1977 | Cunningham | 313/231.11 X |
| 4,065,692 | 12/1977 | Osterhout | 313/326 X |
| 4,563,608 | 1/1986 | Lawson et al. | 313/231.71 |
| 4,755,719 | 7/1988 | Limpaecher | 313/231.21 |

*Primary Examiner*—Donald J. Yusko
*Assistant Examiner*—Sandra L. O'Shea
*Attorney, Agent, or Firm*—Seed and Berry

[57] ABSTRACT

A spark gap chamber to promote mixing and/or translation of hot residue gases into the surrounding gases in an unpurged spark gap chamber. The shock (and expansion) waves are reflected from walls and other structures within the spark gap chamber to cause the hot residue gases formed by a spark between the electrodes in the spark channel to mix with the unheated gases found elsewhere in the spark gap chamber. The spark gap chamber walls can be symmetric and shaped to cause the reflected shock wave to converge simultaneously on the spark channel or to focus on different portions of the spark channel at different appropriate times. Alternatively, the spark gap chamber walls can be asymmetric with respect to the spark channel and can force the hot residue gases away from the spark channel. In another alternative, the spark gap chamber can include structures whose pressure drop depends upon the direction of flow past the structure and, accordingly, can generate a circulation in response to the passing shock (and expansion) waves created by the spark in the spark channel.

28 Claims, 7 Drawing Sheets

METHOD AND APPARATUS FOR ENHANCING SPARK CHANNEL RECOVERY BY SPARK-GENERATED UNSTEADY FLOWS

TECHNICAL FIELD

This invention relates to gas-insulated spark gap switches, and more particularly, to a method and an apparatus for producing unsteady flows in unpurged spark gaps.

BACKGROUND ART

Spark gaps can operate as switches to control the flow of very large electrical currents under high voltage conditions. Typical applications include accelerators, radars, and pulsed laser systems. Spark gaps operate to prevent the flow of electrical current in high voltage applications by filling the space between a pair of electrodes with an insulating gas. When current flow is desired, a trigger pulse on an intermediate electrode or some other means is used to change the state of the insulating gas and thus create a more conductive path. The lower resistance locally leads to a rapid breakdown of the gas between the electrodes, which very rapidly produces a very low resistance conduction path or spark channel through the insulating gas, transferring electrical energy and change from source to load, and releasing high energy in various forms. Besides the light energy produced by the spark, significant amounts of thermal energy are also deposited in the gas. In addition, the rapid temperature change of the gas in the spark gap results in a series of shock and expansion waves that move outwardly from the spark gap.

Before the spark gap has recovered and can hold the high voltage of another high-energy pulse, the gas between the spark and electrodes must be returned to approximately its initial state or replaced with fresh gas. One way of rapidly increasing the resistance of the gas in the spark channel is to introduce a purge gas flow in a flow channel which sweeps the hot residue produced by preceding sparks downstream and introduces a new charge of the gas into the spark channel. While such methods are effective, it can require a great deal of energy and mechanical hardware to circulate the purge gas flow at high pulse repetition frequencies.

It is therefore desirable to have a flow channel and a spark gap switch that can operate at higher power levels and pulse repetition frequencies without requiring an externally supplied purge gas.

DISCLOSURE OF THE INVENTION

It is an object of the present invention to provide a spark gap switch having an internal circulating fluid flow in the spark gap switch without the need to circulate a purge gas.

It is another object of the present invention to provide a spark gap switch having a circulating fluid flow that is produced through the energy of the shock waves produced by the spark gap switch.

It is yet another object of the present invention to provide a spark gap switch that establishes an unsteady fluid flow, without the need to circulate a purge gas, in order to mix heated spark channel gases with cooler gases through which the arc did not pass.

It is a still further object of the present invention to provide a method for purging a spark channel of a spark gap switch without actively circulating a purge gas through an external flow channel.

According to one aspect, the invention provides a spark gap switch for transferring electrical power from a source to a load in a series of sparks. The spark gap switch comprises a spark channel having two electrodes for producing the series of sparks therebetween. One electrode is connected to the source and the other electrode is connected to the load. The spark gap switch also comprises a closed spark chamber, defined by a wall, for producing an unsteady flow of the fluid contained within the spark chamber from the spark chamber through the spark channel by resonating the response to each spark produced between the two electrodes. The pulsed flow channel can further comprise an expansion volume connected to the outlet of the spark gap switch.

In another aspect, the present invention provides a method for producing recovery of a spark channel in a spark gap switch having a closed spark chamber. The method comprises the steps of generating a series of shock and expansion waves in response to a series of sparks in the spark chamber, reflecting the series of shock and expansion waves from the surfaces of the closed spark chamber, and causing the series of shock and expansion waves to focus on the spark chamber, thereby inducing local unsteady flows and mixing of hot gases in the spark channel with adjacent cooler gas.

In a further aspect, the present invention provides a method for producing spark channel recovery in a spark gap switch having a closed spark chamber. The method comprises the steps of generating a series of shock and expansion waves in response to a series of sparks in the spark chamber, reflecting the series of shock and expansion waves from structures which cause pressure losses that depend upon flow direction, generating a circulation flow in the spark chamber from the reflected shock and expansion waves, and directing the circulation flow to the spark channel, whereby the gases heated by the spark are mixed with other gases in the spark chamber.

In a still further aspect, the present invention provides a method for producing spark channel recovery in a spark gap switch having a closed spark chamber. The method comprises the steps of generating a series of shock and expansion waves in response to a series of sparks in the spark chamber, reflecting the series of shock and expansion waves from a spark chamber that is asymmetric with respect to the spark channel, generating a flow through the spark chamber that displaces the hot gases from the spark channel, introducing gas from the spark chamber into the spark channel.

BEST MODE FOR CARRYING OUT THE INVENTION

Figure 1A:
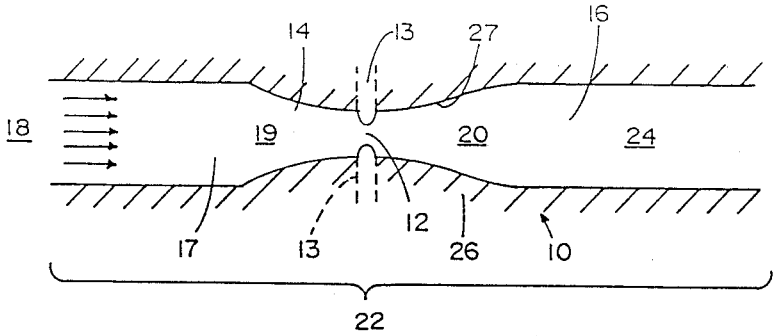
FIG. 1A PRIOR ART
FIG. 1A is a schematic diagram of an externally purged spark gap switch of a prior art gas laser shown in elevational view.
Figure 1B:
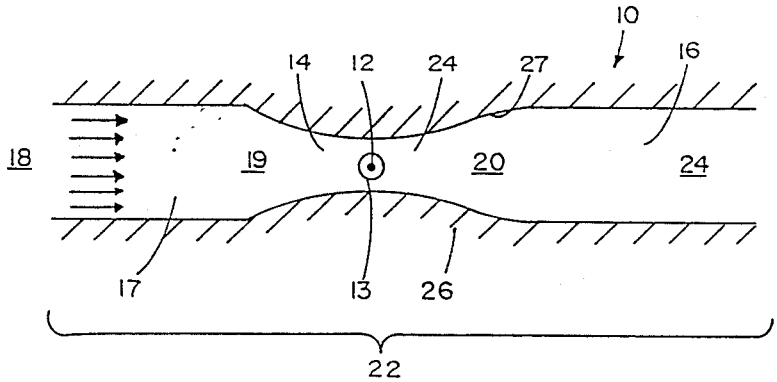
FIG. 1B PRIOR ART
FIG. 1B is a plan view of the prior art spark gap switch of FIG. 1A.

Referring to the schematic diagrams of FIGS. 1A and 1B, an externally purged spark gap switch 10 includes a spark gap or chamber 12 and an inlet 14 to the spark chamber. The spark gap switch 10 is swept by a flow of a purge fluid (e.g., a gas) from a fluid supply 18 at the inlet end 17, through the spark chamber 12 and, via an exhaust duct 24, to an expansion volume 20. The flow fluid supply 18, duct 24, and spark gap switch 10 constitute a flow channel 22.

In accordance with the prior art, the flow channel 22 is designed to use a large, steady flow of purge gas to flush the spark gap of hot residue from the spark prior to the next pulse. This is accomplished by attaching the flow channel 22 (which has a converging cross section as the electrodes are approached) and the expansion volume 20, which has an interior shape diverging outwardly away from the flow channel to an external circulation source (not shown), such as high-pressure storage tanks or a compressor. The shock and expansion waves produced by each spark in the spark chamber 12 propagate throughout the flow channel 22 and the expansion volume 20, interacting in a complex manner which produces time-dependent density changes and an unsteady fluid flow through the spark chamber 12. This unsteady flow is superimposed on the average purge flow. In the prior art, this has caused jitter and non-repeatability of the breakdown voltage, which has been overcome by designing extra spacing into the electrode gap and very strong triggers.

In the configuration of FIGS. 1A and B, dielectric gas flows from a moderately high-pressure source and enters the flow channel 16 through the flow fluid supply 18. When a spark is produced in the spark chamber 12, the passage area changes partially reflect the resulting shock and expansion waves generated by the spark back toward the spark chamber 12 and downstream toward the expansion volume 20. Partial reflections are also caused by shock and expansion wave impingement on other components upstream and downstream of the electrodes. The prior art has ignored the negative effects of shock waves, expansion waves, and unsteady flow on the purge flow requirements and the configuration of purged spark gaps. This will be explained more fully subsequently.

Figure 2:
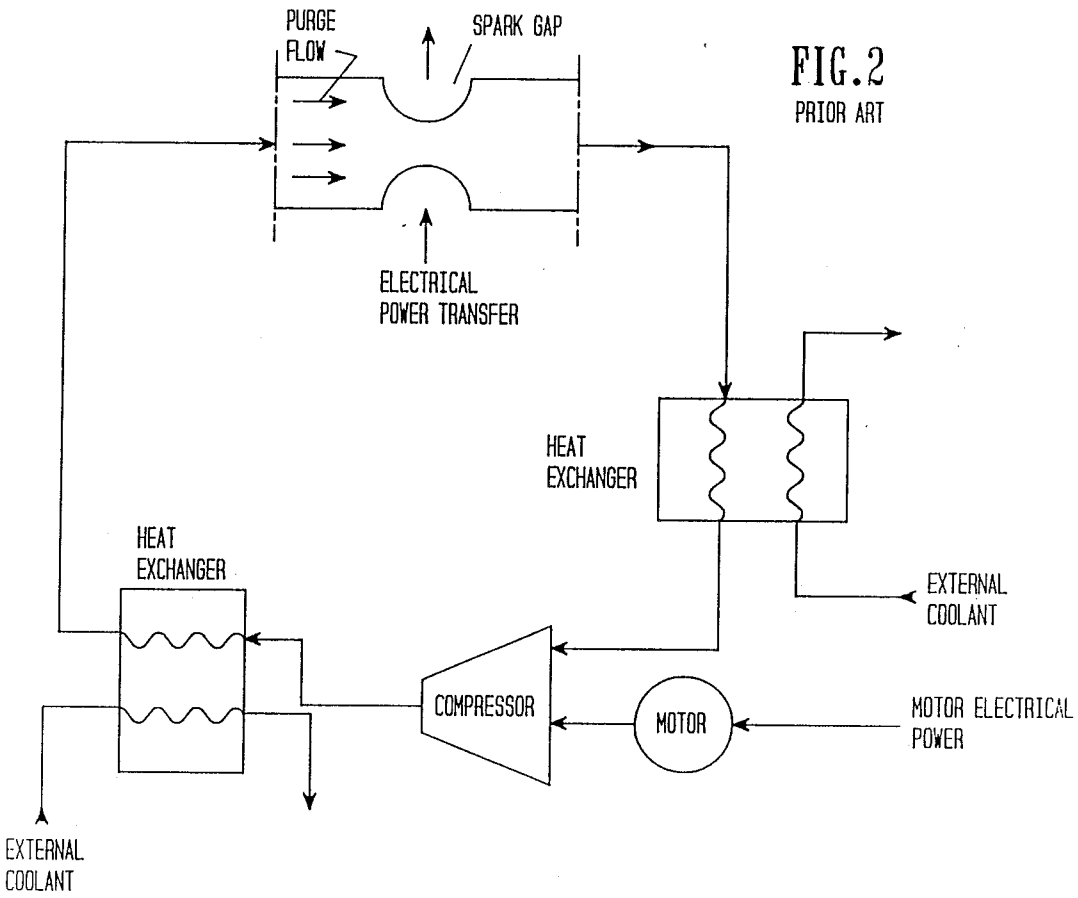
FIG. 2 PRIOR ART
FIG. 2 is a schematic diagram of a closed cycle purged spark gap switch.

The requirement of having an external flow circulation, a closed-cycle version being shown in FIG. 2, is considered undesirable for most applications due to the large components and system size and due also to the power consumption required for high pulse rates.

Five fluid dynamic or thermodynamic mechanisms are available in a simple, gas-insulated spark chamber to affect or enhance recovery of the unpurged chamber. Three fluid dynamic mechanism are (1) unsteady motion to displace the hot residue gases on a transient basis, (2) average motion or circulation of the gas, and (3) mixing of the hot residue with cooler surrounding gas. The final two mechanisms are (4) the increase in the average pressure within the spark chamber (particularly between the electrodes at the time of a subsequent pulse), and (5) thermal radiation from the hot residue gases.

The moderate-to-long times between pulses associated with low-to-moderate pulse repetition frequencies (PRFs) imply that many shock wave reverberations will occur throughout the spark chamber between pulses. Scattering and nonlinear propagation of shock and expansion waves will generally cause the waves to lose their distinct identity and make the pressure relatively uniform within the chamber. This pressure will be higher than the initial pressure due to the energy added by the spark and will increase the gas number density in the spark chamber, but will generally not compensate for the higher temperature between the electrodes. This is illustrated in a prior art spark gap switch symmetric spark chamber 69 shown in FIGS. 3A–C. The spark chamber 69 has a symmetric volume 70 enclosed by a concave chamber wall 72, typically constructed from a dielectric material. The chamber wall 72 is typically designed to provide sufficient surface length to prevent surface flashover and contours to minimize electric field enhancement. Typically, no consideration is given to blast waves or unsteady flow in unpurged spark gap design.

Figure 3A:
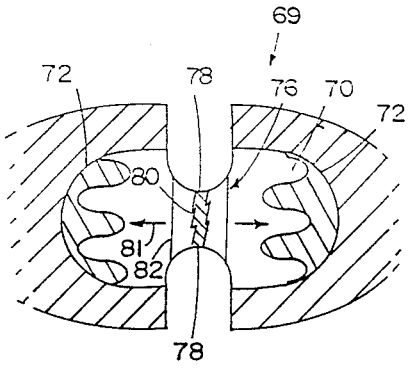
FIG. 3A PRIOR ART
FIG. 3A is a schematic diagram of a symmetric spark chamber of a prior art unpurged spark gap immediately after a spark has occurred in the spark chamber.
Figure 3B:
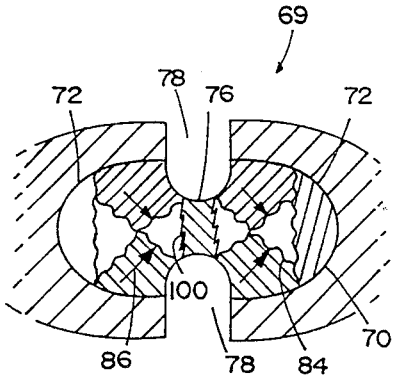
FIG. 3B PRIOR ART
FIG. 3B is a schematic diagram of a symmetric spark chamber of a prior art unpurged spark gap, showing the symmetric shock wave fields in the spark chamber.
Figure 3C:
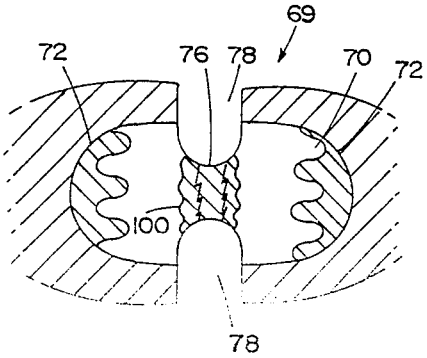
FIG. 3C PRIOR ART
FIG. 3C is a schematic diagram of a symmetric spark chamber of a prior art unpurged spark gap, showing the shock wave system symmetrically compressing the residue gas in the spark chamber in uncontrolled stages due to uncontrolled shockwave reflection from the chamber.

A spark chamber 76 is defined by two electrodes 78. As shown in FIG. 3A, a spark between the electrodes 78 creates a confined volume 80 of heated residue gases, approximately 1.0 mm in diameter, between the electrodes 78 since the spark occurs so quickly that the gas cannot move significantly. The sudden increase in pressure and temperature, to thousands of atmospheres and 20,000+K., in confined volume 80 generates an expanding blast or shock wave 82 and an expansion wave (not shown) which expands outwardly from the confined volume 80, generally in the direction shown by arrows 81. As indicated in FIG. 3B, a symmetric shock wave 82, after reflecting from various portions of the wall 72 at times subsequent to the occurrence of the spark, generates a symmetric pattern composed of outwardly moving shock waves 84 and converging shock waves 86. Because of the symmetry of the shock (and expansion) wave patterns in the chamber volume 70, the hot gas is contained in an expanded volume 100 that remains centrally located in the spark chamber 76, there being no external flows to displace the expanded volume 100 from its symmetric position in the spark chamber 76 (see FIG. 3C). Nonetheless, the residue gases in the expanded volume 100 will experience radiative cooling and some thermal diffusion and mixing with the cooler gases in the remainder of the resonant volume 70. This diffusion and mixing is driven by large temperature gradients and transient flow instabilities.

Unsteady acceleration of a higher density gas by a lower density gas produces a fluid dynamically unstable condition, referred to as a "Rayleigh-Taylor instability," at the interface between the low- and high-density regions. This instability can lead to physical injection of the two media into each other, and to rapid mixing at the interface or contact surface between the two media. In the case of the spark gap chamber 69, shown in FIGS. 3A–C, the interface between the spark chamber residue gases and the cooler surrounding gases is such as to form a contact surface between low- and high-density gases. The passage of shock waves 84 and 86 (and their accompanying expansion waves) through the hot/cold gas interface at the edge of the expanded volume 100 will produce rapid, unsteady accelerations of the contact surface and may cause rapid mixing. However, prior art spark gaps have not considered or been designed to maximize and utilize this instability to enhance mixing and recovery of the spark gap.

Figure 4A:
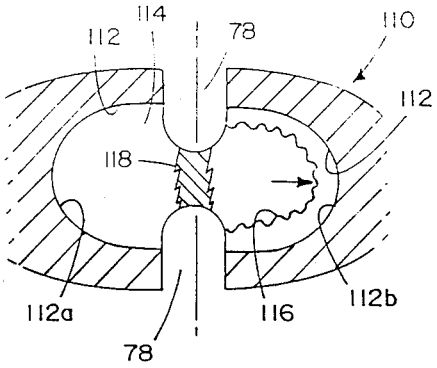
FIG. 4A is a cross-sectional schematic diagram of a symmetric spark chamber of the present invention, showing the shock waves formed by the spark in the spark chamber expanding toward the walls of the spark chamber.
Figure 4B:
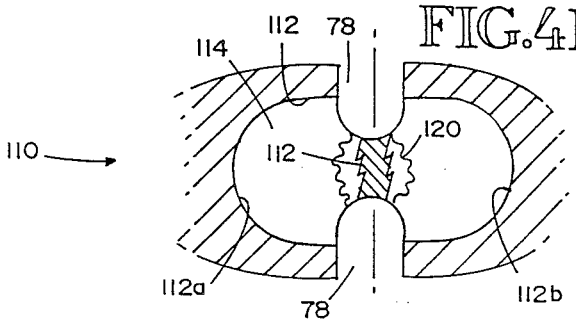
FIG. 4B is a cross-sectional schematic diagram of a symmetric spark chamber of the present invention, showing the shock waves focusing on the hot/cold interface in the spark chamber to promote instability and mixing.

In addition to the mixing effects caused by the Rayleigh-Taylor instability, in the spark gap switch of the present invention a wave reflecting volume is shaped to maximize the strength of these instabilities. In the symmetric spark gap chamber 100 of FIGS. 4A–B, a wall 112 defining the spark chamber 114 has been shaped to focus the reflected pressure waves to arrive at the spark column simultaneously from all points. The wall 112 is formed by two oppositely oriented, approximately half-round wall portions **112*a* and 112*b*. An expanding shock wave 116, which is generated by the rapid heating in a confined volume 118 between the electrodes 78, reflects from the wall 112 along substantially its entire length at the same time. The result, as shown in FIG. 4B, is a reflected shock wave 120 which converges on an expanded volume 122 of heated gases, focusing the strength of the reflected shock and expansion waves on the expanded volume 122 and speeding the mixing and cooling of the hot residue gases between the electrodes 78**.

The mixing effects can be enhanced further through shaping of the spark gap chamber wall to focus the reflected shock and expansion waves to impinge on the ends and center of the hot residue gases at slightly different times. Referring to the embodiment of FIGS. 5A and B, a spark gap chamber 130 has a reverberator volume 132 defined by specially shaped wall 134. The wall is shaped so that different portions of the expanding shock wave generated in a spark chamber 136 between the electrodes 78 reflect from different portions of the wall 134 at different times. This causes the energy of a resulting reflected shock wave 138 to return to the spark chamber 136 at sequential times, causing compression in one region adjacent to an expanding region. Consequently, the pressure in the spark chamber 136 will not be uniform and a confined volume 140 of the heated residue gases will be symmetrically distorted and stirred by the pressure waves, thus increasing the rate of residue cooling.

Figure 5A:
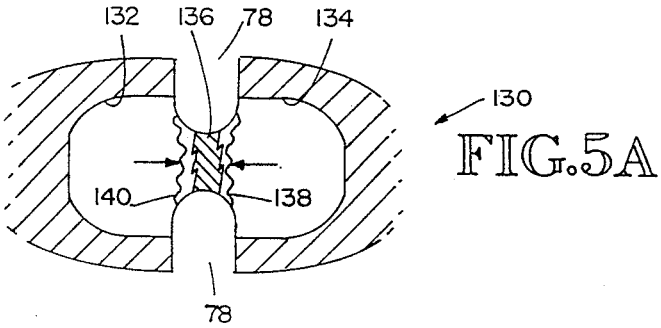
FIG. 5A is a cross-sectional schematic diagram of a symmetric spark gap chamber of a first alternative embodiment of the present invention, showing a shock wave system focusing on the middle of the spark chamber before it focuses on the ends of a spark chamber.
Figure 5B:
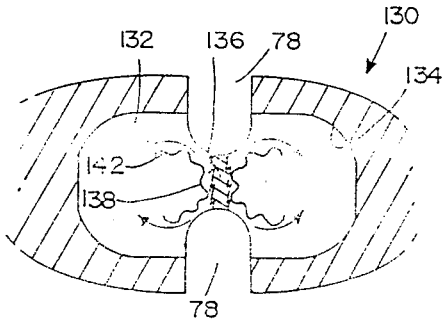
FIG. 5B is a cross-sectional schematic diagram of a symmetric spark gap chamber of a first alternative embodiment of the present invention, showing the secondary gas flow and mixing resulting from focusing shock waves on different parts of the spark chamber at different times.

If, as shown in the exemplary view of FIG. 5A, the center of the confined volume 140 is "pinched" by the return of the reflected shock wave 138, the momentary differences in pressure between the ends and center of the hot residue gases in the confined volume 140 will produce adjacent motions toward or away from the electrodes, as shown in FIG. 5B. A circulating volume 142 of the heated residue gases promotes stirring and mixing of the residue gases, with the cooler gases distributed elsewhere throughout the resonant volume 132.

Proper shaping of the walls 134 can alter the sequence of return of the reflected waves 138 to the spark chamber 136. Specifically, if desired, the reflected shock wave 138 can be caused to pinch the ends of the spark chamber 136 (closest to the electrodes 78) before the center of the confined volume 140 is affected.

The symmetric spark gap chamber configurations shown in FIGS. 4 and 5 enhance the recovery rate in the spark chamber by controlling wave reflections, maximizing instabilities, and stirring the gas, thus promoting mixing of the hot residue gases with the cold surrounding gas and transiently circulating the hot residue gases toward less critical locations in the volume of the spark gap chamber.

Figure 6A:
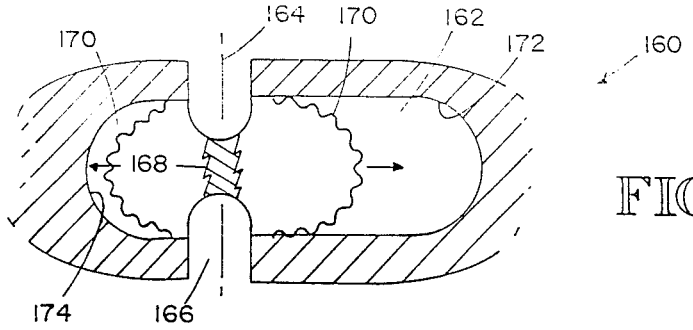
FIG. 6A is a cross-sectional schematic diagram of an asymmetric spark chamber of a second alternative embodiment of the present invention, showing the shock wave system produced by the spark in the spark chamber expanding uniformly toward asymmetric walls of the spark chamber.
Figure 6B:
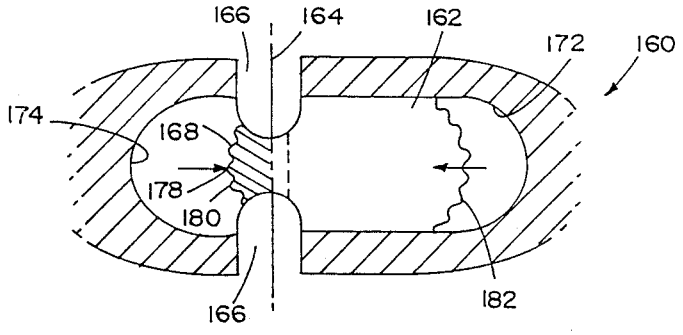
FIG. 6B is a cross-sectional schematic diagram of an asymmetric spark chamber of a second alternative embodiment of the present invention, showing the shock waves produced by the spark in the spark chamber reflecting asymmetrically from the asymmetric walls of the spark chamber.
Figure 6C:
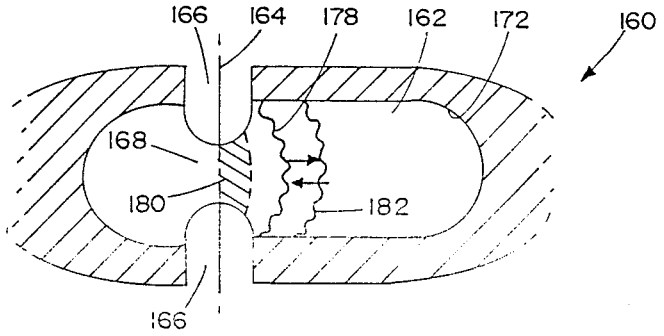
FIG. 6C is a cross-sectional schematic diagram of an asymmetric spark chamber of a second alternative embodiment of the present invention, showing the displacement of the residue gases from the spark chamber due to the asymmetrically arriving shock wave system.

In another embodiment, the spark chamber can be shaped unsymmetrically to create transient gas motions that will displace the hot residue gases from the spark chamber to less critical regions. As shown in FIGS. 6A–C, a spark gap chamber 160 includes a volume 162 that is asymmetric with respect to a center line 164 passing through a pair of electrodes 166 in spark chamber 168. Expanding shock waves 170 (see FIG. 6A) are produced by the rapid pressure change caused by the spark in the spark chamber 168, and impinge at different times upon opposed concave wall portions 172 and 174 that define the volume 162. For example, the expanding shock wave 170 reaches wall portion 174 before it reaches wall portion 172 because wall portion 174 is closer to the spark chamber 168. As a result, as shown in FIG. 6B is a reflected shock wave 178 caused by the reflection from the wall portion 174 reaches the vicinity of a confined volume 180 before a reflected shock wave 182 reflected from the wall portion 172. Subsequently, as shown in FIG. 6C, the confined volume 180 is swept away in a direction toward the far wall portion 172 from the spark chamber 168 by the passage of the reflected shock wave 178 through the spark chamber 168. The instantaneous displacement of the confined volume 180 from the center line 164 of the spark chamber 168 may be large at times, but the net displacement will be relatively small unless very large spark chambers are used. Thus, the hot residue gas in the confined volume 180 will be located near its initial position unless the spark gap chamber 160 is configured to generate an average internal circulation velocity and flow circulation pattern.

Figure 7A:
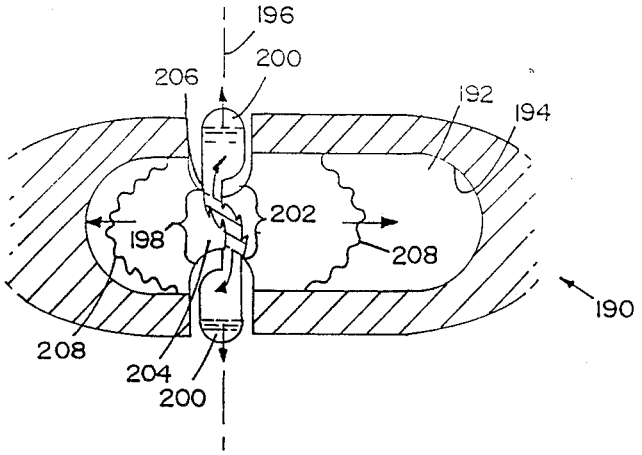
FIG. 7A is a cross-sectional schematic diagram of an asymmetric spark chamber of a third alternative embodiment of the present invention, showing a pressurized gas from the spark chamber entering the hollow electrodes of the spark chamber.

A simple spark gap chamber configuration that will induce circulation from the unsteady gas motion generated by the spark shock waves is shown in FIGS. 7A and B. A spark gap chamber 190 consists of a dielectric gas volume 192 surrounded by a concave, dielectric chamber wall 194. The gas volume 192 is asymmetric with respect to a position center line 196 of a pair of electrodes 198. Each electrode 198 contains a cavity 200 having an opening 202. The openings 202 are placed asymmetrically with respect to the position center line 196 of the electrodes 198 and open into a spark chamber 204.

Figure 7B:
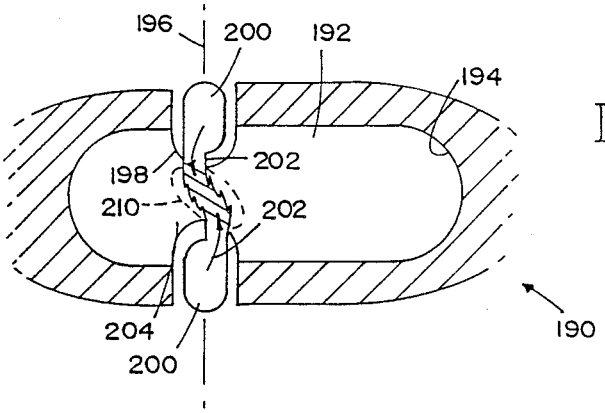
FIG. 7B is a cross-sectional schematic diagram of an asymmetric spark chamber of a third alternative embodiment of the present invention, showing the compressed and cooled gas contained in the asymmetric electrodes of the spark chamber escaping back into the spark chamber.

As shown in FIG. 7A, a confined volume 206 of the residue gases created by a spark discharge between the electrodes 198 generates expanding shock waves 208. Some of the heated residue gases in the confined volume 206 enter the cavities 200 through the openings 202, where they are cooled through cooling means conventionally used in spark chamber electrodes. After the expanding shock waves 208 have reflected from the wall 194 and the pressure in the spark chamber 204 has decreased, the cooled gases contained in the cavities 200 at a higher pressure escape back into the spark chamber 204. As shown in FIG. 7B, the openings 202 effectively form gas jets injecting gas from the cavities 200 into the spark chamber 204 to create a region of increased gas circulation, shown by broken line 210, in the spark chamber 204. The result is that the volume contained in the spark chamber 204 is at a lower temperature as a result of the circulation and, consequently, increases the capability of the spark chamber to hold a spark voltage.

Figure 8B:
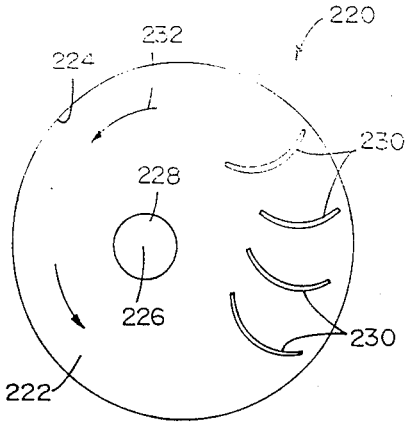
FIG. 8B is a plan view of a schematic diagram of an asymmetric spark chamber of a fourth alternative embodiment of the present invention, showing the asymmetric placement of the flow generating vanes.
Figure 8A:
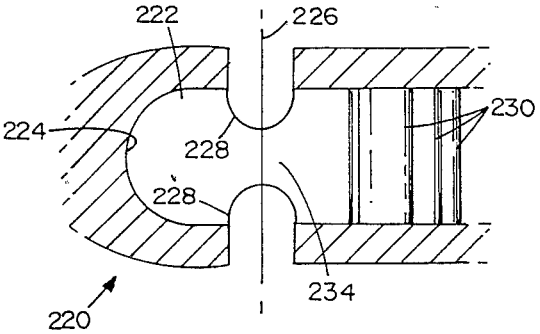
FIG. 8A is an elevational view of a schematic diagram of an asymmetric spark chamber of a fourth alternative embodiment of the present invention, showing the spark chamber containing flow generating means.

The spark gap chamber walls can be configured to generate large-scale transient circulation near the electrodes, in addition to focusing shock and expansion waves to maximize the natural instability that exists when load-density gas accelerates high-density gas. These spark gap configurations will produce large-scale gas motions that will promote mixing of hot and cool gases, cooling of the gas via convection heat transfer to chamber walls, and circulation of the hot residue gas from the electrodes. One such configuration is shown in FIGS. 8A and B. A spark gap chamber 220 includes a dielectric gas volume 222 defined by a dielectric chamber wall 224. The wall 224 is asymmetric with respect to a positional center line 226 of a pair of electrodes 228. Also contained within the resonant volume 222 are a series of vanes 230 that are placed asymmetrically with respect to the center line 226. The structure of the vanes 230 creates pressure differences whose magnitudes depend upon the direction of the unsteady pressure source and flow of the hot gases within the resonant volume 222 past them. An expanding shock wave created by a spark at electrodes 228, when encountering the vanes 230, will generate a circulation flow, indicated by arrows 223 in FIG. 8B, in the resonant volume 222. The circulation flow 232 will sweep a spark chamber 234 (see FIG. 8A) free of the hot residue gases created by a spark. The circulation will also promote mixing of the hot residue gases with the cooler gases surrounding the spark chamber 234.

Figure 9B:
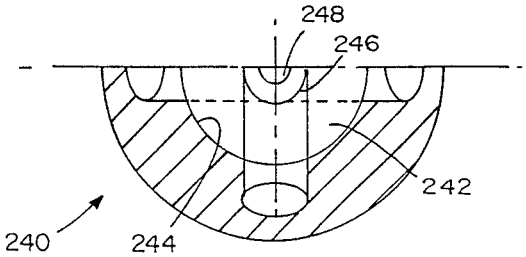
FIG. 9B is a plan view of a schematic diagram of a symmetric spark chamber of a fifth alternative embodiment of the present invention, showing the horizontal placement of low mass check valves.
Figure 9A:
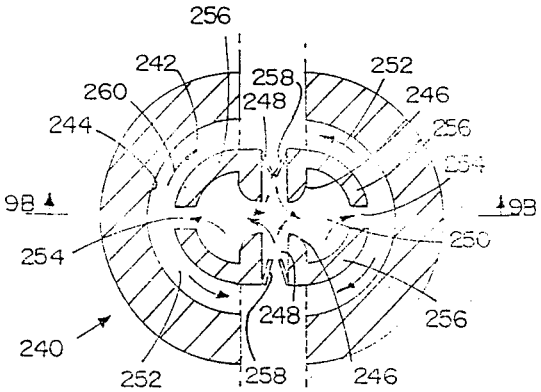
FIG. 9A is an elevational view a schematic diagram of a symmetric spark chamber of a fifth alternative embodiment of the present invention, showing the position of the low mass check valves in the shock wave and flow conducting channels.

Another embodiment of a spark gap chamber 240 in accordance with the present invention is shown in FIGS. 9A and B. The spark gap chamber 240 consists of a dielectric gas volume 242 defined by symmetric, concave chamber wall 244. A dielectric shell 256 is positioned within the resonant volume 242 surrounding the end portions of a pair of electrodes 246 and encompassing a spark chamber 250. The shell 256 is positioned inward of the chamber walls 244 to define a surrounding opening 252 therebetween. The spark gap electrodes 246 each contain an opening 248 which leads from the spark chamber 250 between the electrodes 246 to the surrounding channel 252. A pair of openings 254 in the dielectric shells 256 are located transverse to the spark chamber 250 and lead transversely from the spark chamber 250 to the surrounding channel 252. A one-way valve 258 is located in each of the openings 248. The one-way valves 258 can be reed valves that respond to surrounding pressures or electromechanical valves that are operated at the pulse repetition frequency of the sparks in the spark chamber 250. The one-way valves 258 remain closed to overpressures created in the spark chamber 250 by a spark between the electrodes 246. Consequently, the expanding shock waves created by the spark must expand outwardly through openings 254 to the surrounding channel 252. The resulting overpressure in the surrounding channel 252 travels to the openings 248 of the electrodes 246 in which the one-way valves 258 are positioned. As a result of the overpressure on the outward opening side of the one-way valves 258, or in response to a control signal, the one-way valves 258 open to the pressure wave, permitting the expansion wave to pass through the openings 248 and back into the spark chamber 250. The resulting circulation flow, indicated by arrows 260, promotes self-purging of the hot residues from the electrode region and mixing of the heated residue gases with the gases contained within the remainder of the resonant volume 242.

The best modes of the invention have been explained in the context of a high-power, repetitively pulsed spark gap system. One skilled in the art will readily appreciate that the spark gap switch can be used in other applications requiring the switching of large amounts of electrical power between two electrodes. Another common example is an accelerator.

While various embodiments of the spark gap switch of the present invention have been described above, one skilled in the art will readily appreciate that various modifications of the above-described embodiments may be made without departing from the spirit and the scope of the invention. Accordingly, the spirit and the scope of the present invention are to be limited only by the following claims.

I claim:

1. A spark gap switch for transferring electrical energy from a source to a load in a series of sparks, comprising:

a spark channel having two electrodes for supporting the series of sparks therebetween, one electrode being connected to the source and the other electrode being connected to the load; and a closed spark chamber containing a dielectric fluid and being defined by a wall enclosing the spark channel, the wall being shaped to produce an unsteady flow of the fluid contained within the spark chamber from the spark chamber through the spark channel by resonating the fluid in response to each spark produced between the two electrodes.

2. The spark gap switch of claim 1 wherein the wall is further shaped so that gas residue resulting from one spark in the spark channel is displaced from the spark channel before the next spark is produced.

3. The spark gap switch of claim 1 wherein the closed spark chamber is asymmetric with respect to the spark channel.

4. The spark gap switch of claim 3 wherein each spark in the series of sparks generates shock and expansion waves and the wall is further shaped to cause a gas residue formed by one spark to be instantaneously displaced from the spark channel when the next spark is generated.

5. The spark gap switch of claim 1 wherein the two electrodes are hollow, each having an opening leading asymmetrically with respect to the spark channel into the spark chamber, the openings being positioned to receive therein the fluid compressed by a spark in the spark channel and to subsequently release the compressed fluid with the passage of an expansion wave generated by the spark, the release of the compressed fluid from the asymmetric openings causing a circulation in the spark channel.

6. The spark gap switch of claim 5, further including means for cooling the electrodes, with fluid received therein cooling the electrodes.

7. The spark gap switch of claim 1, further comprising circulation means for inducing a circulation flow of the fluid in the spark chamber through the spark channel.

8. The spark gap switch of claim 7 wherein the circulation means comprises a plurality of wave flow vanes.

9. The spark gap switch of claim 8 wherein the wave flow vanes are placed asymmetrically with respect to the spark channel.

10. The spark gap switch of claim 7 wherein the circulation means induces the circulation flow by causing the pressure losses for flow of the fluid in a first direction to differ from the pressure losses for flow of the fluid in an opposite direction.

11. The spark gap switch of claim 10 wherein the circulation means causes flow separation.

12. The spark gap switch of claim 10 wherein the circulation means comprises fluid flow blockage elements.

13. The spark gap switch of claim 10 wherein the circulation means comprises means for passively opening to allow fluid flow through the spark channel in one direction and closing to prevent fluid flow in an opposite direction.

14. The spark gap switch of claim 13 wherein the passively opening means is located in a flow channel leading from the spark channel back to the spark channel.

15. The spark gap switch of claim 10 wherein the circulation means comprises means for actively opening to allow fluid flow through the spark channel in one direction and closing to prevent fluid flow in an opposite direction.

16. The spark gap switch of claim 15 wherein the actively opening means is located in a flow channel leading from the spark channel back to the spark channel.

17. The spark gap switch of claim 7 wherein the circulation means comprises means for focusing shock and expansion waves generated by the series of sparks onto the spark channel.

18. The spark gap switch of claim 1 wherein the wall is shaped so that the unsteady fluid flow is produced by the acceleration of a higher density gas by a lower density gas.

19. The spark gap switch of claim 1 wherein the spark chamber wall reflects shock and expansion waves generated by the spark channel and focuses the reflected waves onto the spark channel.

20. The spark gap switch of claim 19 wherein the spark channel has two end portions and a center portion extending therebetween, and the spark chamber wall is shaped to focus the reflected shock and expansion waves onto the end portions and the center portion of the spark channel at different times to further mix the gases in the spark channel with surrounding gases.

21. The spark gap switch of claim 1 wherein the spark chamber wall is shaped to produce a series of overpressures in the spark channel generated by the series of sparks.

22. A spark gap switch for transferring electrical energy from a source to a load in a series of sparks, comprising:

pulsed spark means for producing the series of sparks to initiate pulsed lasing action in a laser system, the pulsed spark means having two electrodes, one electrode connected to the source of the electrical energy and the other electrode being connected to the load; and closed chamber means containing a fluid and enclosing the pulsed spark means and being shaped to produce an unsteady flow of the fluid contained within the closed chamber means from the closed chamber means through the pulsed spark means by resonating the fluid in response to each spark produced by the spark gap switch.

23. The spark gap switch of claim 22 wherein the closed chamber means is further shaped so that the gas residue resulting from one spark in the pulsed spark means is displaced from the pulsed spark means before the next spark is produced.

24. A spark gap switch for transferring electrical energy from a source to a load in a series of sparks, comprising:

pulsed spark means for producing the series of sparks to initiate pulsed lasing action in a laser system, the pulsed spark means having two electrodes, one electrode connected to the source of the electrical energy and the other electrode being connected to the load, each spark in the series of sparks generating shock and expansion waves; and closed chamber means enclosing the pulsed spark means, the closed chamber means being shaped asymmetrically with respect to the pulsed spark means and producing an unsteady flow of the fluid contained within the closed chamber means from the closed chamber means through the pulsed spark means by resonating the fluid in response to each spark produced by the spark gap switch and to cause a gas residue formed by one spark to be instantaneously displaced from the pulsed spark means when the next spark is generated.

25. A method for producing recovery of a spark channel that supports sparks in a spark gap switch having a closed spark chamber including walls and containing the spark channel, the spark channel having two end portions and a center portion extending therebetween, the method comprising the steps of:

(a) generating a series of shock and expansion waves in response to a series of sparks produced by the spark channel;

(b) reflecting the series of shock and expansion waves from the walls of the closed spark chamber; and (c) causing the series of shock and expansion waves to focus on the spark channel, thereby increasing the pressure in the spark channel.

26. The method of claim 25 wherein step (c) causes the shock and expansion waves to focus on the end portion and the center portion of the spark channel at different times.

27. A method for producing recovery of a spark channel for generating sparks in a spark gap switch, the spark gap switch having a closed spark chamber enclosing the spark channel, the method comprising the steps of:

(a) generating a series of shock and expansion waves in response to a series of sparks produced in the spark channel;

(b) reflecting the shock and expansion waves from one or more structures contained within the closed spark chamber, the structures causing pressure losses that depend upon the direction of the shock and expansion waves;

(c) generating a circulation flow in the spark chamber from the reflected shock and expansion waves; and (d) directing the circulation flow to the spark channel, whereby the gases heated by the spark are mixed with other gases in the spark chamber.

28. A method for producing recovery of a spark channel that produces sparks in a spark gap switch, the spark gap switch having a closed spark chamber including walls that asymmetrically enclose the spark channel and gases, comprising the steps of:

(a) generating a series of shock and expansion waves in the closed spark chamber and hot gases in the spark channel in response to a series of sparks produced by the spark channel;

(b) reflecting the shock and expansion waves from the asymmetric walls of the spark chamber;

(c) generating a flow through the spark chamber from the reflected shock and expansion waves;

(d) displacing the hot gases from the spark channel with the flow; and (e) replacing the hot gases in the spark channel with unheated gases included in the spark chamber.

* * * * *